US006422292B1

(12) United States Patent
Berry et al.

(10) Patent No.: US 6,422,292 B1
(45) Date of Patent: Jul. 23, 2002

(54) STRETCHING FRAME

(76) Inventors: Troy Van Berry, 316 California Ave., Box #25, Reno, NV (US) 89509; Thomas E. Sheridan, 225 Palace Dr., Reno, NV (US) 89506

( * ) Notice: Subject to any disclaimer, the term of this patent is extended or adjusted under 35 U.S.C. 154(b) by 0 days.

(21) Appl. No.: 09/878,998

(22) Filed: Jun. 13, 2001

(51) Int. Cl.[7] ..... D06C 3/08
(52) U.S. Cl. ..... 160/374.1; 160/381
(58) Field of Search ..... 160/374.1, 377, 160/378, 381, 369, 405, 327; 38/102.4, 102.5, 102.6, 102.8

(56) References Cited

U.S. PATENT DOCUMENTS 1,128,362 A * 2/1915 Rawbon ..... 160/374.1
1,847,925 A 3/1932 Carter
1,916,022 A * 6/1933 Shull ..... 160/374.1
1,916,023 A * 6/1933 Shull ..... 160/374.1
3,494,409 A 2/1970 Prechtl et al.
4,050,498 A * 9/1977 Lucchetti ..... 160/374.1
4,432,150 A 2/1984 Swonger
4,635,700 A 1/1987 Berger
5,052,462 A 10/1991 Stobart
5,271,171 A 12/1993 Smith
5,839,214 A * 11/1998 Peterson ..... 160/374.1 X

* cited by examiner

*Primary Examiner*—David M. Purol
(74) *Attorney, Agent, or Firm*—Siemens Patent Service, LC

(57) ABSTRACT

The present invention presents a stretching frame for fabric materials such as an artist's canvas which can be easily assembled and disassembled, while providing superior rigidity. Unique inner frame members interlock orthogonally along the inner length of outer frame member to prevent the tension of the canvas from deflecting the frame inwardly. Half lapped joints at the corners of the inner frame members provide additional strength for the frame and the ability to adjust the tautness of the canvas in either a single direction or two directions by the insertion of wedges or turnbuckles.

12 Claims, 2 Drawing Sheets

STRETCHING FRAME

BACKGROUND OF THE INVENTION

1. Field of the Invention

The present invention relates to devices for stretching, such as an artist's canvas. More particularly, the invention comprises a system for stretching canvas, or other material, tautly while ensuring that the frame retains a true rectangular shape.

2. Description of the Prior Art

Stretching frames are used for a variety of purposes, including the stretching of artists' canvas or other materials. Rigidity and the ability to expand the outer perimeter of the frame are both important elements for maintaining tautness in the stretched canvas, especially as the size of the frame increases. A number of different approaches have been taken to ensure that these factors are met, including:

U.S. Pat. No. 5,271,171, issued to David C. Smith on Dec. 21, 1993, presents a COMPRESSIBLE AND EXPANDABLE STRETCHING FRAME WITH ADJUSTABLE CORNER BRACKETS, wherein opposite pairs of hollow, open ended tubes are joined by corner brackets slidably inserted into the open ends of the tubes, thereby form a rectangular frame. A groove formed into each of the four tubes creates a channel around the interior perimeter of the rectangular frame for receiving an edge of a silk screen fabric which is held, under tension by a locking rod. A tensioner, consisting of a compressible spring and within an internally threaded hole and an externally threaded nut, incorporated in each leg of the corner brackets provides adjustable tension to the silk screen fabric. The present invention requires only eight interlocking wooden members, making it less costly and, due to the unique interlocking method, more rigid, and, due to its simplicity, components of various sizes may be combined to construct a multitude of frame sizes.

U.S. Pat. No. 5,052,462, issued to John Stobart on Oct. 1, 1991, presents a CANVAS TENSIONING PICTURE FRAME, wherein the four members forming the sides of the rectangular frame are each cut at a 45° angle. Each angled end has two half round cavities cut therein with a tapered half bore from one cavity to the other, such that when two members are joined the cavities form two full round cavities joined by a tapered bore, the upper cavity having an opening of lesser diameter open to the surface of the frame. An disk having a lip around its perimeter occupies the upper cavity, extending through the, while a disk having a bored center occupies the lower cavity. Fitted into a square aperture at the center of the upper disk is a square headed, frustoconical screw which engages the tapered bore between the upper and lower cavities. A clockwise rotation of this screw forces the two abutting members of the frame apart, thus forcing a stretching of the canvas, allowing periodic tightening of a slackened canvas. Again, the present invention requires only eight interlocking wooden members, making it less costly and, due to the unique interlocking method, more rigid, and, due to its simplicity, a multitude of frame sizes can be produced with only a small investment in pairs of opposite members.

U.S. Pat. No. 4,635,700, issued to Gustav A. Berger on Jan. 13, 1987, presents a SELF-ADJUSTING CANVAS TENSIONING FRAME, wherein a canvas is stretched over a rigid frame with constant tension being maintained on the canvas by a series of adjustable springs. The canvas is rigidly attached to a first side of the frame by tacks. The two adjacent sides of the canvas are wrapped around the rigid frame and secured by tensioning springs mounted through the canvas at grommets. The fourth edge of the frame consists of an outer frame member fastened to the frame by bolts passing through coil springs under compression such that the outer frame member is disposed to being force outward from the inner frame. The fourth edge of the canvas is rigidly attached to this outer frame member by tacks while the end of the two adjacent sides are attached to the outer frame member by tensioning springs as the rest of their length has been attached to the rigid frame. Constant tension is thereby maintained on the canvas. Once again, the present invention requires only eight interlocking wooden members, making it less costly and, due to the unique interlocking method, more rigid, and, due to its simplicity, a variety of different frame sizes can made by simply using various pairs of opposite members.

U.S. Pat. No. 4,432,150, issued to Russell A. Swonger on Feb. 21, 1984, presents a STRETCHER FRAME FOR AN ARTISTS CANVAS, wherein the four members forming the sides of the rectangular frame are each compound mitered at a 45° angle such that a canvas may be mounted with only the extreme edge in contact with the frame. A dovetail channel is cut diagonally across the corners such that joined side members are held in place by a complementary dovetail key. With a canvas mounted to the frame, tension can be adjusted by inserting wedges into the joints between adjacent side members. Due to its unique interlocking method, the present invention provides a more rigid frame.

U.S. Pat. No. 3,494,409, issued to Robert A. Prechtl, et. al., on Feb. 10, 1970, presents a COLLAPSIBLE STRETCH FRAME AND CANVAS, wherein the four members forming the sides of the rectangular frame are each mitered at a 45° angle and one face of each is dadoed such that a canvas may be mounted with only the extreme edge in contact with the frame. The inside corners of adjacent side members are mortised to receive a wedge for securing the adjacent sides. The canvas is rigidly secured to two opposite sides by staples or tacks and to the remaining two sides by retaining devices forcing the canvas into a groove cut into the outer surface of the members. Prechtl does not make any specific provision for re-tensioning the canvas after it has been mounted to the frame, but rather allows for ease of assembly and disassembly of the frame, even after the canvas has been mounted. Due to its unique interlocking method, the present invention provides a more rigid frame.

U.S. Pat. No. 1,847,925, issued to Robert A. Carter on Mar. 1, 1932, presents a STRETCHER, wherein the four members forming the sides of the rectangular frame are each mitered at a 45° angle, with each corner having both a square mortise and corresponding square tenon. With such a mortise and tenon arrangement, the mortise of one side member engages the tenon of the second while the mortise of the second member engages the tenon of the first. With such a configuration, either one or two wedges can be driven into each corner of the frame to cause expansion of the joint in either or both of the two directions. Due to its unique interlocking method, the present invention provides a more rigid frame.

None of the above inventions and patents, taken either singly or in combination, is seen to describe the instant invention as claimed.

SUMMARY OF THE INVENTION

Stretching frames are used for a variety of purposes, including the stretching of artists' canvas or other materials. Rigidity and the ability to expand the outer perimeter of the frame are both important elements for maintaining tautness in the stretched canvas, especially as the size of the frame increases. The present invention, through its unique interlocking member system, offers a means to overcome these problems.

Accordingly, it is a principal object of the invention to provide a stretching frame which is economical.

It is another object of the invention to provide a stretching frame which provides a high degree of rigidity.

It is a further object of the invention to provide a stretching frame with which it is easy to adjust tension on the installed canvas.

Still another object of the invention is to provide a stretching frame which can be erected in a variety of different sizes with a minimal investment in materials.

An additional object of the invention is to provide a stretching frame which can be produced from a variety of different materials.

It is again an object of the invention to provide a stretching frame which is easily disassembled and stored or transported.

Yet another object of the invention is to provide a stretching frame which is resistant to warping or deformation in any direction.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
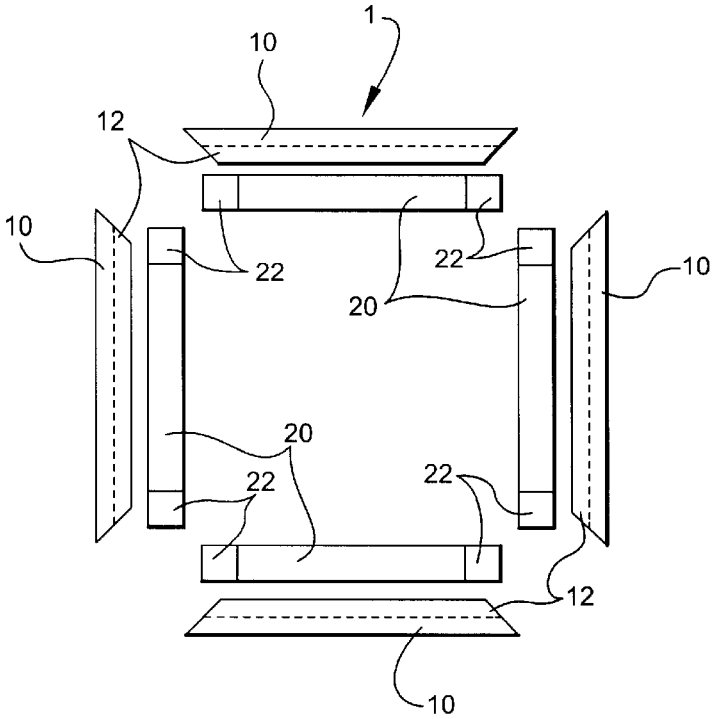
FIG. 1 is an exploded plan view of the invention.
Figure 2:
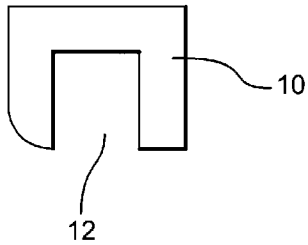
FIG. 2 is an end view of an outer frame member.
Figure 3:
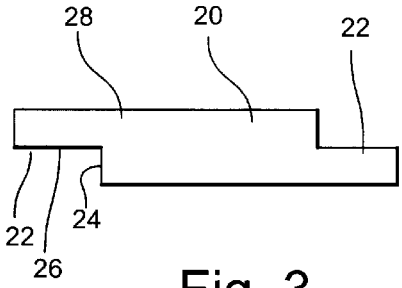
FIG. 3 is a side view of an inner frame member.
Figure 4:
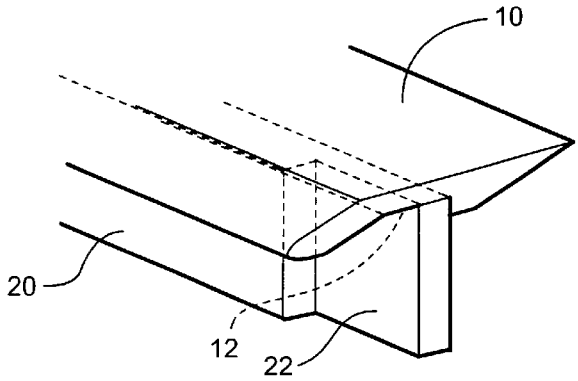
FIG. 4 is a perspective view an assembled side member.

Referring now to FIGS. 1, stretching frame 1 is made up of a combination of only two basic elements, outer frame member 10 and inner frame member 20. Outer frame member 10 has two ends, each mitered at approximately a 45° angle, and a dado 12 (FIG. 2) which receives inner frame member 20. Inner frame member 20, engaged orthogonally along its length with outer frame member 10 to provide added rigidity, has a half lap cut 22 at each of its two ends, one half lap cut 22 in each of the two horizontal faces of inner frame member 20 (FIG. 3). Each half lap cut 22 has a kerf 24, a lap face 26, and two lap sides 28. It would be evident to one skilled in the art that both half lap cuts 22 could be made in the same horizontal face of inner frame member 20 or in the opposite horizontal faces of inner frame member 20 with equal effectiveness. Inner frame member 20 is dimensioned equal to the longer, inner dimension of dado 12 (FIG. 4), and each half lap cut 22 is dimensioned to present a square cut to receive the corresponding half lap cut 22 of the adjacent inner frame members 20 (FIG. 5) when mated orthogonally.

Stretching frame 1 may be assembled to any desired dimensions by selecting pairs of outer frame members 10 and inner frame members 20, matching the desired frame dimensions. It would be evident to one skilled in the art that stretching frame 1 could be marketed in pre-packaged combinations of standard dimensions or as pairs of frame members from which custom sized frames could be assembled.

Figure 5:
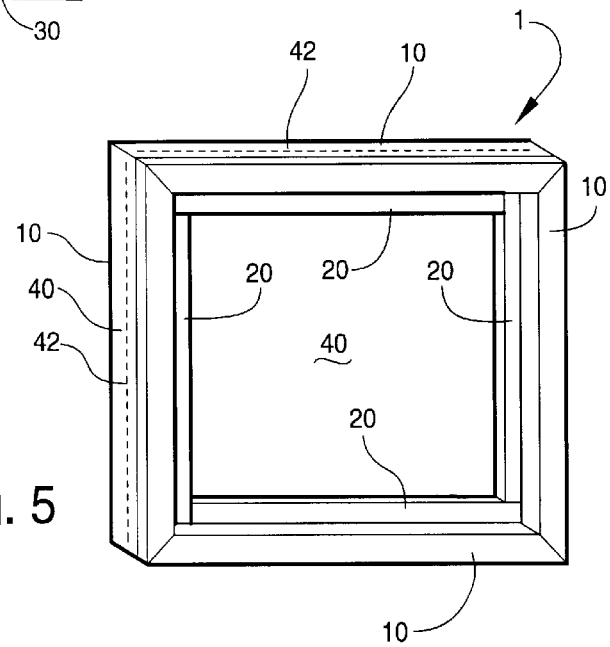
FIG. 5 is a perspective view, from the back, of the invention with canvas installed.
Figure 7:
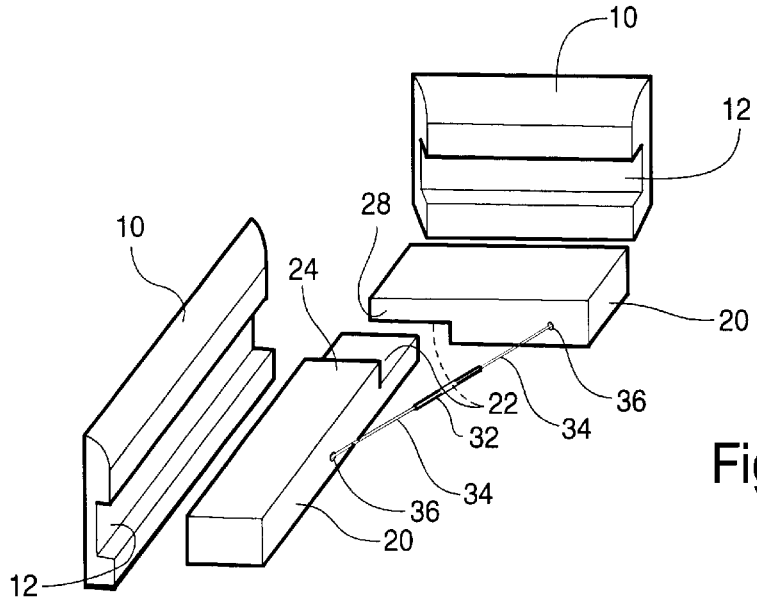
FIG. 7 is an exploded perspective view showing detail of an assembled corner of the invention using turnbuckles as expanders.

For assembly, inner frame members 20 are first laid out orthogonal to one another, forming a rectangle, with half lap cuts 22 mated. Outer frame members 10 are then fitted over the mated inner frame members 20 to complete stretching frame 1 (FIG. 5). It would be evident to one skilled in that art that outer frame member 10 and inner frame member 20 could be glued during their joining, either in manufacture or during assembly by the user. An artist's canvas 40 or other material may be fitted over stretching frame 1 and fastened to the outer perimeter of stretching frame 1 by any known fastening means, such as, but not limited to tacks or staples 42 (FIG. 5).

Tension on the installed canvas 40 or other material can be adjusted, if necessary, by inserting wedges 30 (FIG. 6) into the lap joints, between kerf 24 and of one half lap cut 22 and lap side 28 of the second half lap cut 22, each wedge 30 forcing lateral movement of inner frame member 20, and thus outer frame member 10, to which it is parallel. A second wedge inserted between kerf 24 and lap side 28 of the mated half lap cut 22 forces lateral movement of the second inner frame member 20. Unlike typical mitered corner frames where a wedge exerts expansion in two directions, a first wedge 30 may be driven into a lap joint parallel to a first inner frame member 20 to tighten a canvas in a first direction, and, if necessary, a second wedge 30 may be driven parallel to the second inner frame member 20 of a corner joint to tighten the canvas in a second direction. Due to the offset of inner frame member 20 from the mounting face of outer frame member 10, the danger of damage to the canvas 40 is eliminated.

Figure 6:
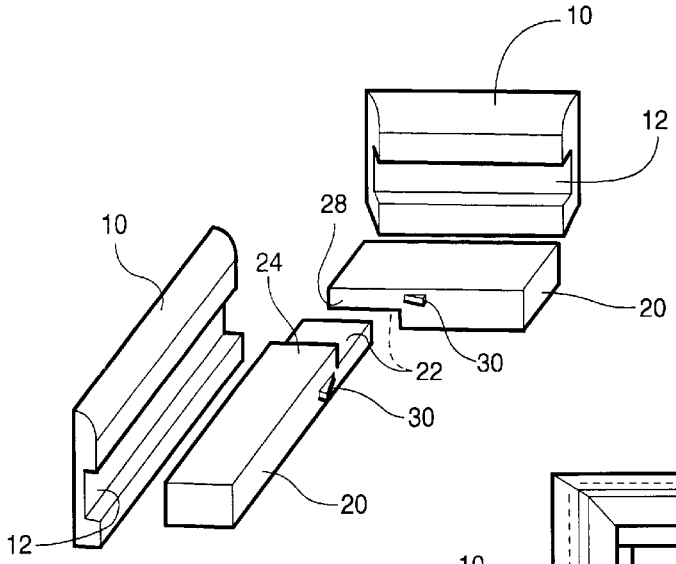
FIG. 6 is an exploded perspective view showing detail of an assembled corner of the invention using wedges as expanders.

In an alternative embodiment, a turnbuckle 32 mounted at each corner of the stretching frame 1 is used for tensioning of the canvas (FIG. 6). Turnbuckle 32 has the free end of each of its adjusting rods 34 set into a turnbuckle receptor 36 drilled at approximately a 45° angle proximate the end of each inner frame member 20. Expansion of turnbuckles 32 causes expansion of stretching frame 1 creating tension on canvas 40, while contraction of turnbuckles 32 releases the amount of tension that stretching frame 1 exerts on canvas 40.

It would be evident to one skilled in the art that the present invention could be produced of a variety of different materials, including, but not limited to, wood or polymeric materials.

It is to be understood that the present invention is not limited to the embodiments described above, but encompasses any and all embodiments within the scope of the following claims.

What is claimed is:

1. A frame for stretching a fabric material, comprising:

means for stretching said fabric material taut, further comprising:

a plurality of outer frame members, each of said outer frame members having two ends, each of said two ends being cut at a diagonal from the length of said outer frame member, and a dado cut into the shorter length of said outer frame member as created by said diagonal cut of each of said two ends;

a plurality of inner frame members, each of said inner frame members being equal in length to said dado of the corresponding of said outer frame member at the longest dimension of said dado as formed by said diagonal of cut of each of said two ends of said outer framing member greater in width than the depth of said dado, and equal in depth to the width of said dado, and having two ends, each of said two ends having a half lap cut, equal in length to the width of said inner frame member, such that when joined orthogonally a full half lapped joint is formed; and means for adjusting the tension on said fabric.

2. A frame for stretching a fabric material, as defined in claim 1, comprising:

two pairs of opposing parallel sides, each side comprising:

a said outer frame member, and a said inner frame member.

3. A frame for stretching a fabric material, as defined in claim 2, wherein said two pairs of opposing sides are of equal length, forming a square frame.

4. A frame for stretching a fabric material, as defined in claim 2, wherein said two pairs of opposing sides are of differing lengths, forming a rectangular frame.

5. A frame for stretching a fabric material, as defined in claim 1, wherein the first of said half lap cuts is situated on a first end of said inner frame member and on a first side of said inner frame member, and the second of said half lap cuts is situated on a second end of said inner frame member and on a second side of said inner frame member, opposite said first side of said inner frame member.

6. A frame for stretching a fabric material, as defined in claim 1, wherein the first of said half lap cuts is situated on a first end of said inner frame member and on a first side of said inner frame member, and the second of said half lap cuts is situated on a second end of said inner frame member and on said first side of said inner frame member.

7. A frame for stretching a fabric material, as defined in claim 1, wherein said means for adjusting the tension on said fabric material comprises:

inserting a wedge between the kerf of a first of said half lap cuts and the side of a second of said half lap cuts, causing expansion of said half lapped joint in a first direction, and inserting a second wedge between said kerf of said second of said half lap cuts and said side of said first of said half lap cuts, causing expansion of said half lapped joint in a second direction, orthogonal to said first direction.

8. A frame for stretching a fabric material, as defined in claim 1, wherein said means for adjusting the tension on said fabric comprises a turnbuckle at each corner of said frame in combination with said half lapped joints.

9. A frame for stretching a fabric material, comprising:

two pairs of opposing parallel sides, each side comprising:

an outer frame member having:

two ends, each of said two ends being cut at a diagonal from the length of said outer frame member, and a dado cut into the shorter length of said outer frame member as created by said diagonal cut of each of said two ends;

an inner frame member having:

a length equal to that of said dado of the corresponding of said outer frame member at the longest dimension of said dado as formed by said diagonal of cut of each of said two ends of said outer frame member, a depth equal to the width of said dado, and a width greater than the depth of said dado, two ends, each of said two ends having a half lap cut, equal in length to the width of said inner frame member, such that when joined orthogonally a full half lapped joint is formed; and a plurality of wedges for adjusting the tension on a canvas stretched on said frame.

10. A frame for stretching a fabric material, comprising:

two pairs of opposing parallel sides, each side comprising:

an outer frame member having:

two ends, each of said two ends being cut at a diagonal from the length of said outer frame member, and a dado cut into the shorter length of said outer frame member as created by said diagonal cut of each of said two ends;

an inner frame member having:

a length equal to that of said dado of the corresponding of said outer frame member at the longest dimension of said dado as formed by said diagonal of cut of each of said two ends of said outer frame member, a depth equal to the width of said dado, and a width greater than the depth of said dado, two ends, each of said two ends having a half lap cut, equal in length to the width of said inner frame member, such that when joined orthogonally a full half lapped joint is formed; and a plurality of turnbuckles for adjusting the tension on a canvas stretched on said frame.

11. A method for stretching a fabric material, in combination with a frame for stretching a fabric material, wherein said frame for stretching a fabric material comprises:

two pairs of opposing parallel sides, each side comprising:

an outer frame member having:

two ends, each of said two ends being cut at a diagonal from the length of said outer frame member, and a dado cut into the shorter length of said outer frame member as created by said diagonal cut of each of said two ends;

an inner frame member having:

a length equal to that of said dado of the corresponding of said outer frame member at the longest dimension of said dado as formed by said diagonal cut of each of said two ends of said outer frame member, a depth equal to the width of said dado, a width greater than the depth of said dado, and two ends, each of said ends having a half lap cut, equal in length to the width of said inner frame member, such that when joined orthogonally a full half lapped joint is formed; and a plurality of wedges for adjusting the tension on a canvas stretched on said frame; and said method for stretching a fabric material further comprises:

arranging said inner frame members, forming a rectangular shape, such said half lap cuts of adjacent of said inner frame members overlap forming full half lapped joints at each of the four corners of said rectangular shape, fitting said dados of each of said outer frame member over the corresponding of said inner frame member such that said mitered ends of adjacent of said outer frame members abut, attaching a first edge of said fabric material to the outer edge of a first of said outer frame members by a fastening means, stretching said canvas across said stretching frame and attaching the opposite edge of said canvas to the outer edge of the opposing of said outer frame members, attaching a third edge of said canvas to the outer edge of a third of said outer frame members, and attaching the fourth edge of said canvas to the outer edge of the fourth of said outer frame members; and adjusting the tension on said canvas by inserting one of said wedges between the kerf of a first of said half lap cuts and said side of a second of said half lap cuts, causing expansion of said half lapped joint in a first direction, and inserting one of said wedges between said kerf of said second of said half lap cuts and said side of said first of said half lap cuts, causing expansion of said half lapped joint in a second direction, orthogonal to said first direction.

12. A method for stretching a fabric material, in combination with a frame for stretching a fabric material, wherein said frame for stretching a fabric material comprises:

two pairs of opposing parallel sides, each side comprising:

an outer frame member having:

two ends, each of said two ends being cut at a diagonal from the length of said outer frame member, and a dado cut into the shorter length of said outer frame member as created by said diagonal cut of each of said two ends;

an inner frame member having:

a length equal to that of said dado of the corresponding of said outer frame member at the longest dimension of said dado as formed by said diagonal cut of each of said two ends of said outer frame member, a depth equal to the width of said dado, a width greater than the depth of said dado, and two ends, each of said ends having a half lap cut, equal in length to the width of said inner frame member, such that when joined orthogonally a full half lapped joint is formed; and a plurality of turnbuckles for adjusting the tension on a canvas stretched on said frame; and said method for stretching a fabric material further comprises:

arranging said inner frame members, forming a rectangular shape, such said half lap cuts of adjacent of said inner frame members overlap forming full half lapped joints at each of the four corners of said rectangular shape, fitting said dados of each of said outer frame member over the corresponding of said inner frame member such that said mitered ends of adjacent of said outer frame members abut, attaching a first edge of said fabric material to the outer edge of a first of said outer frame members by a fastening means, stretching said canvas across said stretching frame and attaching the opposite edge of said canvas to the outer edge of the opposing of said outer frame members, attaching a third edge of said canvas to the outer edge of a third of said outer frame members, and attaching the fourth edge of said canvas to the outer edge of the fourth of said outer frame members, fitting one of said turnbuckles into turnbuckle receptors situated in each of the two ends of each of said inner frame members; and adjusting the tension on said canvas by adjusting each of said turnbuckles causing expansion of said half lapped joints.

* * * * *